US006321617B1

(12) United States Patent
Schwyn

(10) Patent No.: US 6,321,617 B1
(45) Date of Patent: Nov. 27, 2001

(54) ADJUSTABLE PEDAL ASSEMBLY

(76) Inventor: Jeffrey Schwyn, 10841 Waldron Rd., Jerome, MI (US) 49249

( * ) Notice: Subject to any disclaimer, the term of this patent is extended or adjusted under 35 U.S.C. 154(b) by 0 days.

(21) Appl. No.: 09/590,581

(22) Filed: Jun. 8, 2000

(51) Int. Cl.[7] ..... G05G 1/14
(52) U.S. Cl. ..... 74/512
(58) Field of Search ..... 74/512, 513, 514, 74/560

(56) References Cited

U.S. PATENT DOCUMENTS

| | | | |
|---|---|---|---|
| 3,151,499 | 10/1964 | Roe | 74/560 |
| 3,563,111 | 2/1971 | Zeigler . | |
| 3,643,524 | 2/1972 | Herring . | |
| 3,975,972 | 8/1976 | Muhleck | 74/560 |
| 4,386,537 | 6/1983 | Lewis | 74/512 |
| 5,306,136 | 4/1994 | Oomori et al. . | |
| 5,329,657 | 7/1994 | Bartley et al. . | |
| 5,351,573 | 10/1994 | Cicotte . | |
| 5,460,061 * | 10/1995 | Redding et al. | 74/512 |
| 5,520,068 | 5/1996 | Karch | 74/512 |
| 5,771,752 | 6/1998 | Cicotte | 74/512 |
| 5,855,143 | 1/1999 | Ewing | 74/512 |
| 5,884,532 | 3/1999 | Rixon et al. . | |
| 5,996,439 | 12/1999 | Elton et al. . | |
| 6,019,015 | 2/2000 | Elton . | |
| 6,151,985 * | 11/2000 | Garber et al. | 74/512 |
| 6,212,970 * | 4/2001 | Bortolon | 74/512 |

* cited by examiner

*Primary Examiner*—Mary Ann Green
(74) *Attorney, Agent, or Firm*—Warn, Burgess & Hoffman, P.C.

(57) ABSTRACT

An adjustable pedal assembly used in connection with a vehicle. The assembly provides a constant pedal ratio produced through use of a separate pedal arm and drive arm having a common center pivot. The distance from the pedal pad to the center pivot and the drive arm actuator rod mounting point to the center pivot is held stationary. By holding these distances stationary while varying the angle or angular relationship between the pedal arm and drive arm, the travel of the actuator rod related to the travel of the pedal pad remains proportional.

18 Claims, 3 Drawing Sheets

ADJUSTABLE PEDAL ASSEMBLY

BACKGROUND OF THE INVENTION

1. Field of the Invention

The present invention relates generally to a pedal assembly for use with a motor vehicle. More specifically, the invention relates to a pedal having a position that is adjustable to accommodate various users of the motor vehicle.

2. Description of the Related Art

Conventional motor vehicles use various types of pedal assemblies to control the brakes, accelerator and, if the vehicle has a manual transmission, the clutch. A vehicle operator operates the pedals. Motor vehicles are currently designed for the "average" driver. Thus, some adjustment is necessary to ensure that the driver can fully operate the control pedals at all times. Typically, this adjustment is accomplished by repositioning the operator's seat rather than repositioning the pedals. However, the various differences in the physical sizes of various operators along with an individual operator's overall physical characteristics require adjustments that are not easily obtainable by adjusting the position of the seat with respect to the pedals.

Systems that adjust the position of the pedal with respect to the vehicle operator are known, i.e., the vehicle operator remains stationary and the position of the pedals with respect to the operator changes. Such systems can be very complex, costly, require increased maintenance and provide varying pedal and actuation characteristics depending upon the position of the pedal. Accordingly, it is desirable to have a control pedal that adjusts relative to the position of the vehicle operator, maintains proper pedal ratios and does not vary the mechanical advantage of the pedal.

SUMMARY OF THE INVENTION

Accordingly, the present invention is an adjustable pedal apparatus for actuating a device on a motor vehicle. The apparatus is supported within a pedal compartment of the vehicle interior, typically through use of a pivot pin supported within the vehicle compartment by a support bracket. A pedal arm is pivotally secured to the pivot pin. The pedal arm includes a pedal pad attached to the lower end thereof for receiving a force from the vehicle operator to actuate the device. A drive arm is pivotally connected to the pivot pin and is also connected to an actuator rod used to actuate the device. A link is pivotally connected on a first end thereof to the pedal arm and is adjustably secured on a second end thereof to the drive arm for movement to various positions on the drive arm to vary the angular position or relationship between the pedal arm and the drive arm.

An adjuster varies the position of the link on the drive arm. The adjuster includes a threaded member rotatably secured adjacent the drive arm. A drive member threadably engages the threaded member and is connected to the link. Rotation of the threaded member causes movement of the drive member along the threaded member and correspondingly repositions the link.

Other features and advantages of the present invention will be readily appreciated, as the same becomes better understood after reading the subsequent description taken in conjunction with the accompanying drawings.

DETAILED DESCRIPTION OF THE PREFERRED EMBODIMENT(S)

Figure 1:
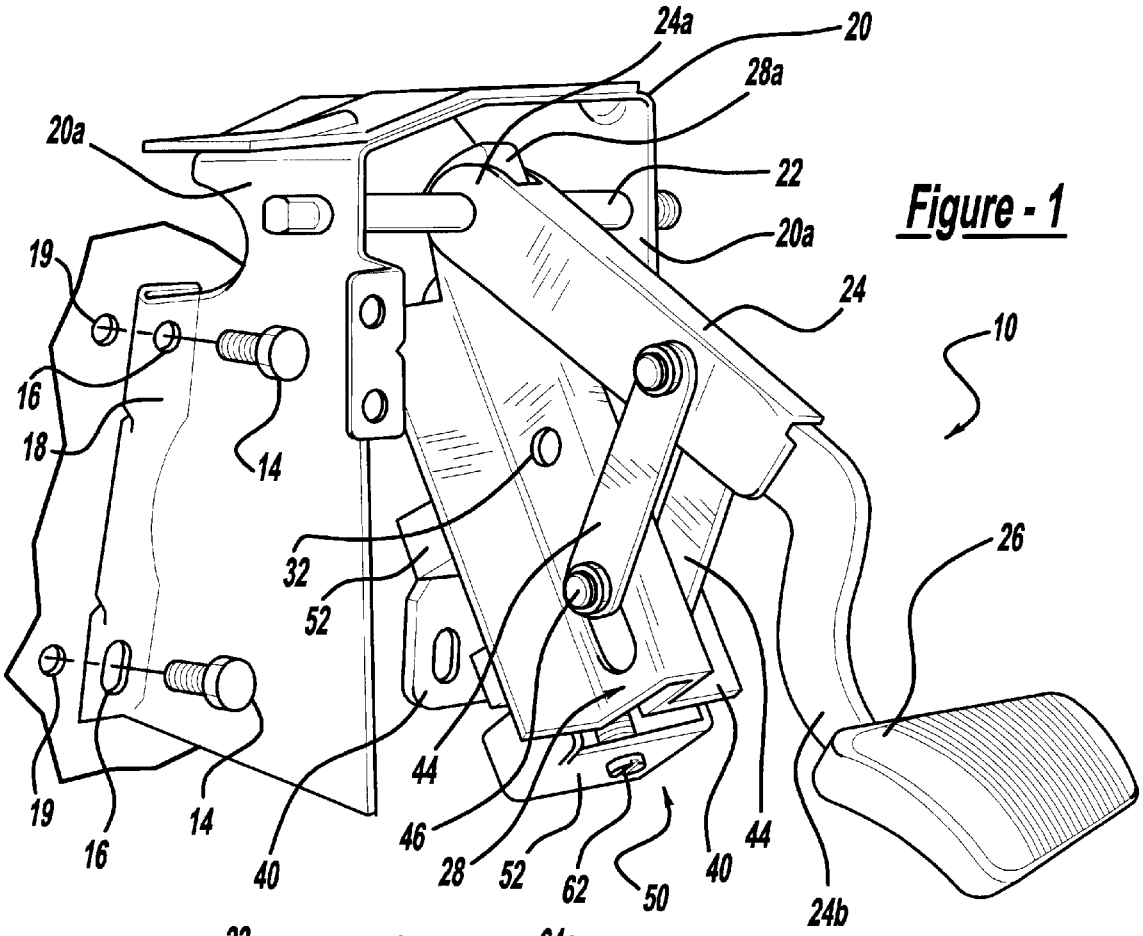
FIG. 1 is a perspective view of an adjustable pedal apparatus for the motor vehicle in accordance with the present invention.

Referring to FIG. 1, an adjustable pedal apparatus according to the present invention is shown. As described herein, the adjustable pedal apparatus is used or attached to an existing brake linkage, not shown, of an automotive or motor vehicle. A typical automotive brake system utilizes a master cylinder actuated by a push or actuator rod typically attached to a brake pedal. The stroke or distance of travel of the push rod remains constant. Thus, depending upon where the push rod is attached to the pedal arm, the stroke of the pedal, i.e., the distance of travel of the pedal pad required to fully actuate or stroke the push rod, remains constant regardless of the position of the operator. Accordingly, such a pedal has a constant pedal ratio.

The inventive adjustable pedal set forth below also maintains a constant pedal ratio. Both the distance from push rod mounting point to the center pivot and the distance from the pedal pad to the center pivot point are held stationary. Thus, the relationship of push rod travel to pedal travel remains proportional to one another.

The pedal control apparatus 10 is positioned within the vehicle interior or operator compartment of a motor vehicle (not shown). The vehicle interior or operator compartment includes a dash panel 12 extending downward toward the floor of the vehicle. The pedal control apparatus 10 may be used as a brake or clutch pedal to actuate and control either or both a brake or clutch mechanism. The pedal control apparatus 10 may also be used to actuate and control an accelerator pedal. An accelerator pedal typically operates by pulling a cable rather than pushing an actuator rod. When used with an accelerator pedal, the pedal control apparatus 10 of the present invention is connected to a pedal arm of the accelerator.

As shown in FIG. 1, the vehicle interior or operator compartment includes a support bracket 20. The support bracket 20 is secured to the dash panel 12 by fasteners 14 extending through apertures 16 in a flanged section 18 of the support bracket 20. The fasteners 14 are received in threaded bores 19 located in the dash panel 12. The support bracket 20 may also be connected to the steering column or instrument panel of the vehicle to provide additional support therefor.

As shown in the drawings, the pedal control apparatus 10 is pivotally supported within the vehicle interior or operator compartment by a pivot pin 22 that extends through the support bracket 20 and is secured to opposite side walls 20*a* of the support bracket 20. A first end 24*a* of the pedal arm 24 is secured to the pivot pin 22 such that the pedal arm 24 pivots about the pivot pin 22. Secured to a second end 24*b* of the pedal arm 24 is a pedal pad 26.

A drive arm 28 is pivotally secured at a first end 28*a* to the pivot pin 22. An actuator rod 30 used to actuate the brake assembly connects to the drive arm 28 at an aperture 32 in the drive arm 28. Conventionally, the actuator rod 30 is rotatably attached to the drive arm 28 with a pivot pin (not shown) that passes through both the drive arm 28 and the actuator rod 30. As the drive arm 28 pivots about the pivot pin 22 it causes reciprocal motion of the actuator rod 30 thereby actuating the brake assembly.

Figure 6:
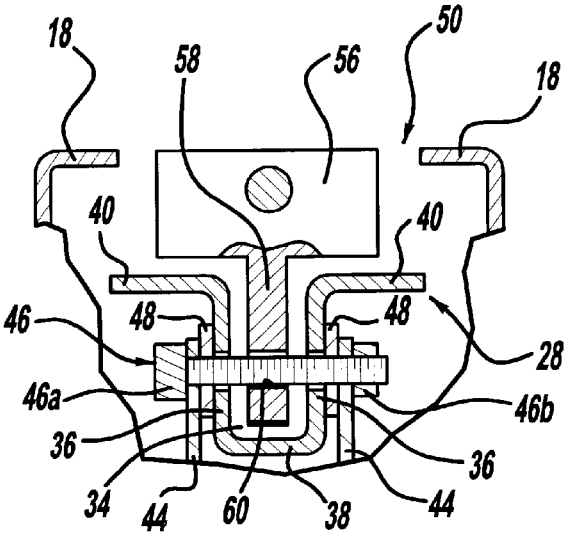
FIG. 6 is a fragmentary sectional view taken on lines 6—6 of FIG. 2.

As shown in the drawings, the drive arm 28 is a U-shaped member 34 having parallel legs 36 interconnected by a base 38. The legs 36 form a channel 66. The drive arm 28 further includes outwardly extending transverse flange members 40. The legs 36 of the drive arm 28 each have an elongated slot 42. A pair of links 44 are pivotally secured at the first ends 44*a* thereof to the pedal arm 24. While shown herein as a pair of adjuster links, use of a single adjuster link is also suitable to practice the invention. The second ends 44*b* are secured to the drive arm 28 by a pin 46 extending through the elongated slots 42 in the drive arm 28. As shown in FIG. 6, a pair of washers 48 are positioned between the links 44 and the drive arm 28. The washers 48 are made of a suitable low friction-type material to facilitate movement of the pin 46 and corresponding links 44 along the length of the elongated slot 42 in the drive arm 28. The pin 46 is shown as a threaded fastener 46*a* receiving a nut 46*b* to secure the pin 46 in position. When using a threaded fastener 46*a*, care must be taken to avoid over-tightening the nut 46*b* which compresses the links 44 against the drive arm 28 and prevents the links 44 from moving back and forth in the elongated slot 42.

Figure 2:
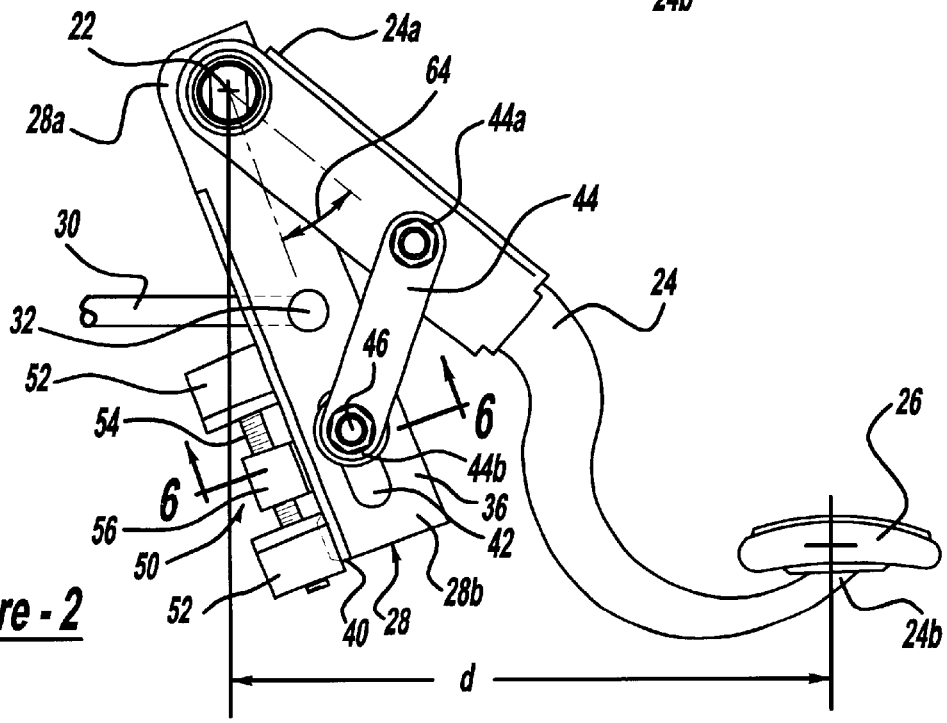
FIG. 2 is a side view of an adjustable pedal apparatus for a motor vehicle according to the present invention shown in a first position.
Figure 3:
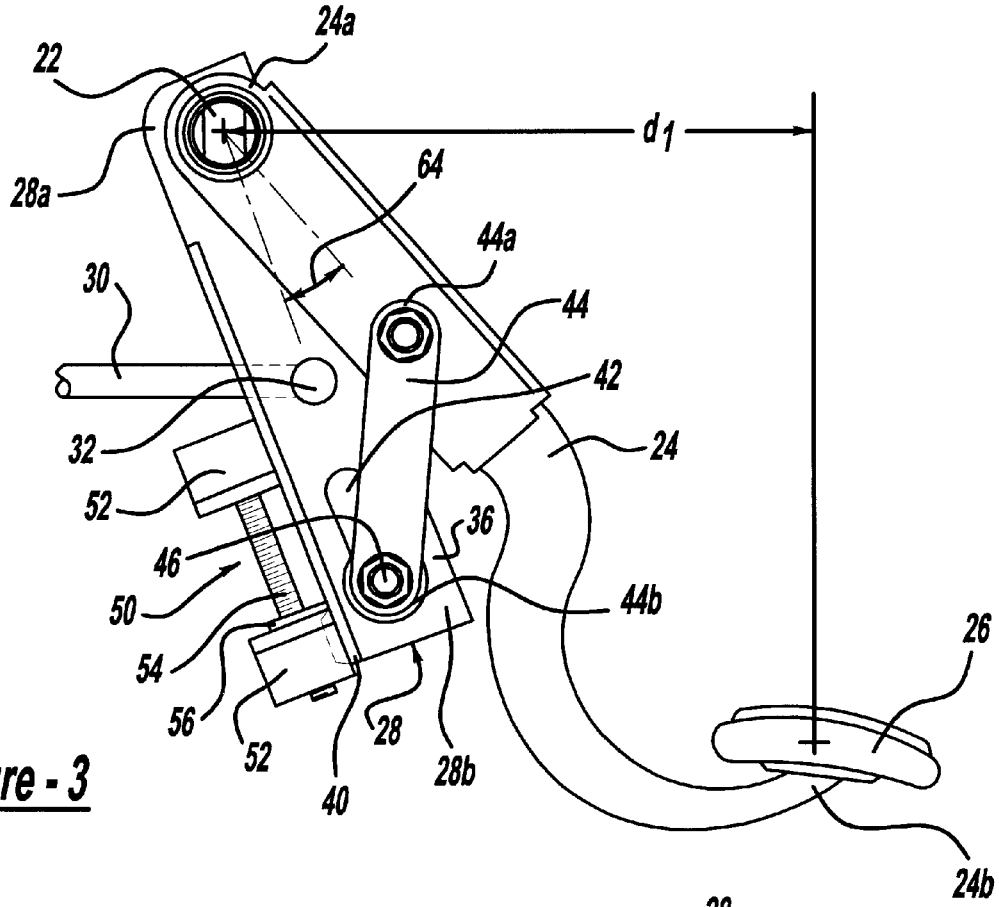
FIG. 3 is a side view of an adjustable pedal apparatus for a motor vehicle according to the present invention shown in a second position.

Accordingly, movement of the links 44 along the length of the elongated slot 42 varies the angular relationship between the pedal arm 24 and the drive arm 28. As shown in FIG. 2, as the pin 46 travels in the elongated slot 42 away from the second end 28*b* of the drive arm 28, the distance (d) between the pivot pin 22 and pedal pad 26 increases. Correspondingly, as shown in FIG. 3, as the pin 46 travels in the elongated slot 42 toward the second end 28*b* of the drive arm 28, the distance (d) from the pivot in 22 to the pedal pad 26 decreases. Thus, the position of the drive arm 28 remains constant and the stroke of the actuator rod 30 does not change regardless of the position of pedal arm 24. Adjusting the position of the pedal pad 26 in this manner maintains the ratio of pedal pad 26 travel distance to actuator rod 30 stroke.

Figure 5:
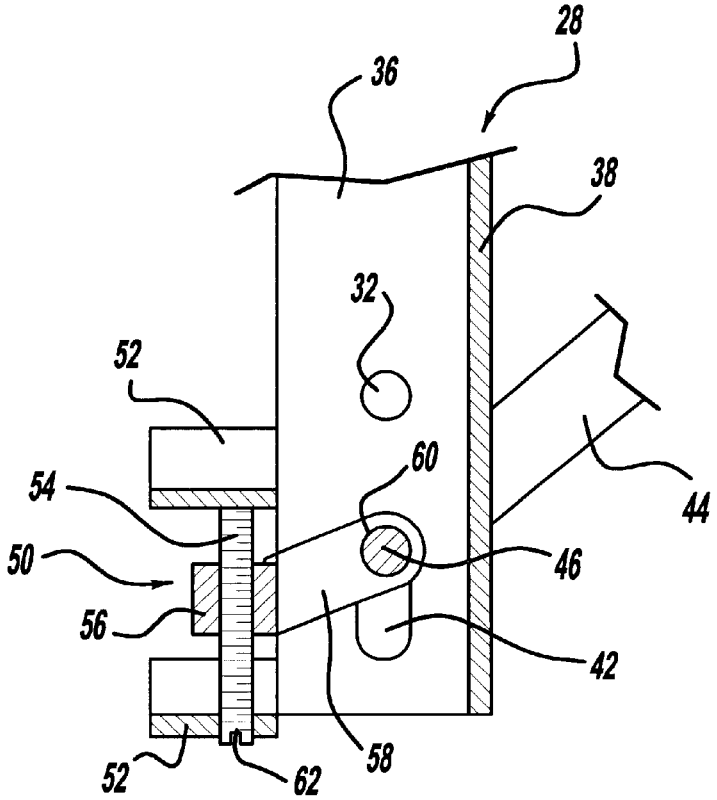
FIG. 5 is a side view, partly in section, taken on lines 5—5 of FIG. 4.
Figure 4:
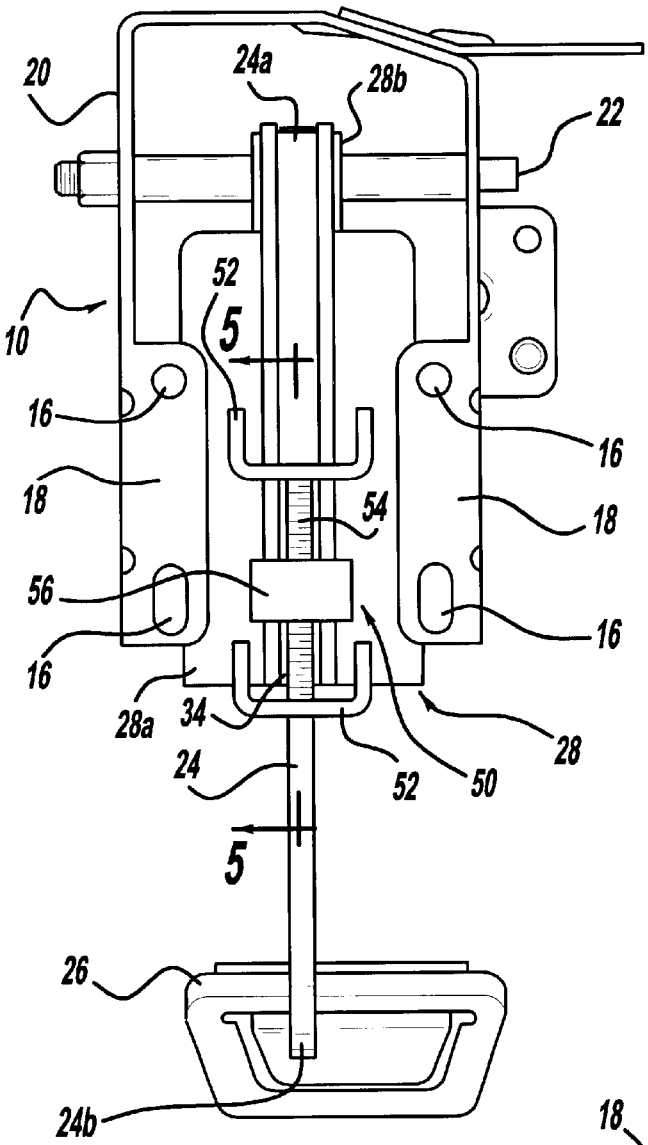
FIG. 4 is a back view of an adjustable pedal apparatus for a motor vehicle according to the present invention.

An adjuster, seen generally at 50, properly positions the pin 46 within the elongated slot 42 to correspondingly adjust the position of the pedal pad 26. The adjuster 50 includes a pair of adjuster supports 52 secured to the flange members 40 of the drive arm 28. As shown in FIGS. 4–5, the adjuster supports 52 are secured in a spaced apart relationship. Extending between the adjuster supports 52 and journaled therein for rotational movement is a threaded member or adjuster screw 54. A drive member 56 trapped between the adjuster supports 52 threadably engages the threaded member or adjuster screw 54. The drive member 56 further includes a finger portion 58 that extends outward and into the channel 66 of the drive arm 28. The finger portion 58 has an aperture 60 therein. The pin 46 extends through the aperture 60 on the finger portion 58. As the threaded member or adjuster screw 54 rotates, the drive member 56 travels along the length of the threaded member or adjuster screw 54 between the adjuster supports 52. It should be understood that the length of the threaded member or adjuster screw 54 corresponds with the length of the elongated slot 42. Thus, to reposition the pedal pad 26, the threaded member or adjuster screw 54 is rotated causing the drive member 56 to travel along the threaded member or adjuster screw 54 and correspondingly move the pin 46 and the second end 44*b* of the links 44 along the elongated slot 42.

As shown in the present embodiment, one end of the threaded member or adjuster screw 54 has a slot 62 therein. The slot 62 receives a corresponding tool, such as a screwdriver, used to rotate the threaded member or adjuster screw 54.

Although the adjuster 50 shown herein adjusts manually, it is within the scope of this invention to use a motor or other power transfer device to rotate the threaded member or adjuster screw 54 and correspondingly reposition the pedal pad 26. Further, the controls to operate such an adjuster 50 are typically positioned within easy access of the vehicle operator. Thus, the operator may simply press a button to move the pedal pad 26 either closer to or farther away from the operator's foot depending upon the operator's individual requirements.

The adjuster 50 is not restricted to the preferred embodiment set forth above. Any assembly mechanism or part that operates to reposition the links 44 on the drive arm 28 is contemplated as part of the invention disclosed herein.

As shown in FIGS. 2–3, movement of the second ends 44*b* of the links 44 along or on the drive arm 28 does not vary the position of the drive arm 28. Instead, it varies the angle 64 between the pedal arm 24 and the drive arm 28. Use of the common pivot pin 22 maintains the consistency of the pedal ratio by maintaining the relationship and the distance from the pivot pin 22 to the pedal pad 26 and the distance from the pivot pin 22 to the actuator rod 30 constant throughout complete adjustable movement. Thus, changing the angular relationship between the drive arm 28 and the pedal arm 24 provides adjustability while maintaining a constant pedal ratio.

The invention has been described in an illustrative manner. It is to be understood that the terminology used is intended to be in the nature of words of description rather than of limitation.

Many modifications and variations of the invention are possible in light of the above teachings. Therefore, within the scope of the appended claims, the invention may be practiced other than as specifically described.

I claim:

1. An adjustable pedal assembly for use with a vehicle comprising:

a support bracket;

a pedal arm pivotally secured to said support bracket, said pedal arm including a pedal pad attached thereto;

a drive arm pivotally secured to said support bracket;

a link having a first end and a second end, said first end of said link pivotally secured to said pedal arm and said second end of said link moveably secured to said drive arm to vary the position of said second end of said link on said drive arm; and an adjuster secured to one of said link and said drive arm and further connected to and operative to vary the position of said second end of said link on said drive arm.

2. An adjustable pedal assembly as set forth in claim 1 including a pin, said pin pivotally connecting said adjuster to said link.

3. An adjustable pedal assembly as set forth in claim 2 including said drive arm having an elongated slot therein; and said pin pivotally connecting said adjuster to said link extending through said elongated slot.

4. An adjustable pedal assembly as set forth in claim 3 wherein the length of said elongated slot defines a range of adjustment of the adjustable pedal assembly.

5. An adjustable pedal assembly as set forth in claim 3 wherein said drive arm is U-shaped having a base and two spaced apart legs joined by said base and forming a channel therebetween, said elongated slot formed in at least one of said spaced apart legs.

6. An adjustable pedal assembly as set forth in claim 5 wherein said adjuster includes an adjuster screw positioned adjacent said drive arm;

a drive member threadably engages said adjuster screw for movement along said adjuster screw in response to rotation of said adjuster screw; and said drive member connected to said pin pivotally connecting said adjuster to said link.

7. An adjustable pedal assembly as set forth in claim 6 wherein said drive member includes a finger portion, said finger portion having an aperture therein, said finger portion extending into said channel on said U-shaped member such that the aperture in said finger portion coincides with said elongated slot; and said pin extending through said aperture and said slot to couple said drive member to said link.

8. An adjustable pedal assembly as set forth in claim 1 including said drive arm having an elongated slot therein; and a pin extending through said elongated slot and connected to said link, said pin further connecting said link to said adjuster.

9. An adjustable pedal assembly as set forth in claim 8 wherein said drive arm is a U-shaped member having a base and two spaced apart legs joined by said base and forming a channel therebetween, said elongated slot formed in at least one of said spaced apart legs.

10. An adjustable pedal assembly as set forth in claim 9 wherein said adjuster includes an adjuster screw positioned adjacent said drive arm;

a drive member threadably engages said adjuster screw for movement along said adjuster screw in response to rotation of said adjuster screw; and said drive member connected to said link.

11. An adjustable pedal assembly as set forth in claim 10 wherein said drive member includes a finger portion, said finger portion having an aperture therein, said finger portion extending into said channel of said U-shaped member such that the aperture in said finger portion coincides with said elongated slot; and said pin extending through said aperture and said slot to couple said drive member to said link.

12. An adjustable pedal assembly for use with a vehicle comprising:

a pivot pin;

a pedal arm pivotally supported by said pivot pin, said pedal arm including a pedal pad attached thereto;

a drive arm pivotally supported by said pivot pin, said pivot pin providing a common pivot point for both said pedal arm and said drive arm;

a link having a first end and a second end, said first end of said link pivotally secured to said pedal arm and said second end of said link movably secured to said drive arm to vary the position of said second end of said link on said drive arm; and an adjuster secured to one of said link and said drive arm and further connected to and operative to vary the position of said second end of said link on said drive arm.

13. An adjustable pedal assembly as set forth in claim 12 wherein said drive arm is a U-shaped member having a base and two spaced apart legs joined by said base and forming a channel therebetween, said U-shaped member further having an elongated slot formed in at least one of said spaced apart legs.

14. An adjustable pedal assembly as set forth in claim 13 wherein said adjuster includes an adjuster screw positioned adjacent said drive arm;

a drive member threadably engages said adjuster screw for movement along said adjuster screw in response to rotation of said adjuster screw; and said drive member connected to said link.

15. An adjustable pedal assembly as set forth in claim 14 wherein said drive member includes a finger portion, said finger portion having an aperture therein, said finger portion extending into said channel of said U-shaped member such that the aperture in said finger portion coincides with said elongated slot; and said pin extending through said aperture and said slot to couple said drive member to said link.

16. An adjustable pedal assembly for use with a vehicle comprising:

a pivot pin;

a pedal arm pivotally supported by said pivot pin, said pedal arm including a pedal pad attached thereto;

a drive arm pivotally supported by said pivot pin, said pivot pin providing a common pivot point for both said pedal arm and said drive arm;

a link having a first end and a second end, said first end of said link pivotally secured to said pedal arm and said second end of said link movably secured to said drive arm to vary the position of said second end of said link on said drive arm;

an adjuster screw positioned on said drive arm;

a drive member threadably engages said adjuster screw for movement along said adjuster screw in response to rotation of said adjuster screw; and said drive member connected to said link and operative to vary the position of said second end of said link on said drive arm.

17. An adjustable pedal assembly as set forth in claim 16 wherein said drive arm is a U-shaped member having a base and two spaced apart legs joined by said base and forming a channel therebetween, said U-shaped member further having an elongated slot formed in at least one of said spaced apart legs.

18. An adjustable pedal assembly as set forth in claim 17 wherein said drive member includes a finger portion, said finger portion having an aperture therein, said finger portion extending into said channel of said U-shaped member such that the aperture in said finger portion coincides with said elongated slot; and said pin extending through said aperture and said slot to couple said drive member to said link.

* * * * *